US006660383B2

(12) United States Patent
Toyoda et al.

(10) Patent No.: US 6,660,383 B2
(45) Date of Patent: Dec. 9, 2003

(54) MULTIFIBROUS CARBON FIBER AND UTILIZATION THEREOF

(75) Inventors: Masahiro Toyoda, Fukui (JP); Yoshio Sohda, Kanagawa (JP); Yukinori Kude, Kanagawa (JP); Tsutomu Kihara, Kanagawa (JP); Osamu Katou, Kanagawa (JP)

(73) Assignee: Nippon Mitsubishi Oil Corporation, Tokyo (JP)

( * ) Notice: Subject to any disclaimer, the term of this patent is extended or adjusted under 35 U.S.C. 154(b) by 0 days.

(21) Appl. No.: 09/766,800

(22) Filed: Jan. 22, 2001

(65) Prior Publication Data

US 2001/0051272 A1 Dec. 13, 2001

(30) Foreign Application Priority Data

Jan. 21, 2000 (JP) ..... 2000-048278

(51) Int. Cl.[7] ..... B32B 9/100

(52) U.S. Cl. ..... 428/408; 428/367; 502/446; 502/526; 442/179; 442/354

(58) Field of Search ..... 428/408, 367, 428/364; 502/416, 526; 442/179, 354

(56) References Cited

U.S. PATENT DOCUMENTS 5,626,650 A * 5/1997 Rodriguez et al. ..... 95/116

* cited by examiner

*Primary Examiner*—Deborah Jones
*Assistant Examiner*—Abraham Bahta
(74) *Attorney, Agent, or Firm*—Dilworth & Barrese LLP.

(57) ABSTRACT

Carbon fiber including graphitized fiber is processed electrochemically in an acidic solution for a time sufficient to run a layer reaction such that the reaction extends to the inside of the fiber and thereafter, as required, heat-treated accurately at 100° C. or more to expand layer spacing to form multifibrous carbon fiber, with which hydrogen is brought into contact, adsorbing hydrogen in the inside of the multifibrous carbon fiber.

21 Claims, 9 Drawing Sheets

EXPLANATORY VIEW OF AN ELECTROCHEMICAL TREATING APPARATUS USED IN THE EXAMPLE (1: CARBON FIBER)

EXPLANATORY VIEW OF AN ELECTROCHEMICAL TREATING APPARATUS USED IN THE EXAMPLE (1: CARBON FIBER)

WIDE-ANGLE X-RAY PROFILE OF CARBON FIBER PRIOR TO ELECTROCHEMICAL TREATMENT

WIDE-ANGLE X-RAY PROFILE OF CARBON FIBER AFTER ELECTROCHEMICAL TREATMENT

SCANNING TYPE ELECTRON MICROPHOTOGRAPH (MAGNIFICATION: 2500) OF CARBON FIBER AFTER ELECTROCHEMICAL TREATMENT.

SCANNING TYPE ELECTRON MICROPHOTOGRAPH (MAGNIFICATION: 800) OF EXPANDED CARBON FIBER.

SCANNING TYPE ELECTRON MICROPHOTOGRAPH (MAGNIFICATION: 12000) OF A PARTIAL SECTION OF EXPANDED CARBON FIBER.

WIDE-ANGLE X-RAY PROFILE OF CARBON FIBER AFTER ELECTROCHEMICAL TREATMENT AND HEAT TREATMENT

AN ADSORPTION ISOTHERM OF THE MULTIFIBROUS CARBON FIBER OF THE PRESENT INVENTION

AN ADSORPTION ISOTHERM OF TYPICAL ACTIVATED CARBON HAVING HIGH SPECIFIC SURFACE AREA

MULTIFIBROUS CARBON FIBER AND UTILIZATION THEREOF

BACKGROUND OF THE INVENTION

1. Field of the Invention

The present invention relates to a multifibrous carbon fiber and its utilization, and, particularly to a multifibrous carbon fiber having the characteristics, such as excellent hydrogen adsorbing ability and oil adsorbing ability. The present invention also relates to a hydrogen adsorbing or hydrogen storage material, a hydrogen adsorbing method and a hydrogen adsorbing carbon.

2. Background of the Invention

Expanded graphite using natural graphite materials as starting material has been known. However, it has the problem of difficult processability.

Also, a fabrication method in which expanded graphite is compression-molded and a binder is added is proposed in the publication of JP 5-96157A. However, the method in which a binder is added is troublesome.

In the meantime, activated carbon and nanomaterial carbon materials such as a carbon nanotube and carbon nanofiber have been known as carbon materials for hydrogen adsorption. Activated carbon is a relatively inexpensive material and is used for a variety of adsorbents in industrial fields. However, activated carbon has small hydrogen adsorbing capacity as the hydrogen adsorbent and therefore has an insufficient performance. Also, the nanomaterial carbon materials such as a carbon nanotube and carbon nanofiber have relatively high hydrogen adsorbing capacity and are hydrogen adsorbents which are expected to be put to practical use. These carbon materials are increased in production and refining costs and therefore have an economical difficulty in utilizing these materials.

As a method of producing the nanomaterial carbon materials, a method of the production of a carbon nanotube and carbon fibril as disclosed in JP 3-174018A, JP 3-64606B and Japanese Patent No. 2982819 and methods of the production of carbon nanofibers as disclosed by Chambers et al., J. Phys. Chem. B, 122, 4253 (1998) and Fan et al., Carbon, 37, 1649 (1999) are known. However, all of these methods adopt a synthetic method by means of a vapor phase method using a metal fine powder as a catalyst, giving rise to the problem of uneasy mass production, troublesome works for the removal of the catalyst and high production costs.

With regard to recent carbon nanotubes, it is inferred and presumed that the carbon nanotube exhibits a highest adsorption density when the carbon nanotube has a diameter of 1.174 nm, namely an inside diameter of 0.7 nm as a calculated optimum size for hydrogen adsorption as reported by, for instance, Darkrim et al., J. Chem. Phys., 109, 4981 (1998) and Wang et al., J. Phy. Chem. B., 103, 4809 (1999). However, no concrete means has been found as to how to produce a carbon material having a pore size close to 0.7 nm and how to use this carbon material for hydrogen adsorption.

On the other hand, the layer distance of graphite is the order of 0.335 to 0.349 nm and therefore graphite cannot be an excellent hydrogen adsorbing body if it is used as a hydrogen adsorbent as it is.

In this respect, expanded graphite using a natural graphite material as starting material has been known as materials having a relatively large layer distance. This expanded graphite has the problem of difficult processability.

OBJECTS OF THE INVENTION

It is an object of the present invention to provide techniques which enables carbon fibers to have new structural characteristics exhibiting excellent hydrogen adsorbing characteristics and oil adsorbing characteristics.

Another object of the present invention is to provide a novel hydrogen adsorbing method, a hydrogen occluding agent, hydrogen adsorbing carbon and a hydrogen adsorbent.

Further objects will be apparent from the following descriptions.

SUMMARY OF THE INVENTION

The present invention is, in an aspect, a multifibrous carbon fiber obtained by processing carbon fiber including graphitized fiber electrochemically in an acidic solution for a time sufficient to run a layer reaction or intercalation reaction such that the reaction extends to the inside of the fiber.

The present invention is, in another aspect, the above carbon fiber, wherein heat treatment is performed at 200 to 1200° C. after the electrochemical treatment to thereby expand the layer spacing.

The present invention is, in a further aspect, a hydrogen adsorbent comprising a carbon fiber layer reaction product which is obtained by processing carbon fiber electrochemically in an acidic solution and contains a carbon structure established such that the diffraction peak position (2θ) obtained by wide-angle x-ray diffraction analysis appears at 9 to 14 degrees.

The present invention is, in a further aspect, a hydrogen adsorbing method comprising bringing hydrogen into contact with the aforementioned hydrogen occluding agent and a hydrogen adsorbing carbon obtained by the method.

The present invention is, in a further aspect, a hydrogen adsorbing method comprising bringing hydrogen into contact with a carbon fiber layer reaction product which is obtained by processing carbon fiber electrochemically in an acidic solution and contains a carbon structure established such that the diffraction peak position (2θ) obtained by wide-angle x-ray diffraction analysis appears at 9 to 14 degrees.

The present invention is, in a further aspect, a method of adsorbing and desorbing hydrogen, the method comprising adsorbing hydrogen in the inside of multifibrous carbon fiber by bringing hydrogen into contact with a carbon fiber layer reaction product which is obtained by processing carbon fiber electrochemically in an acidic solution and contains a carbon structure established such that the diffraction peak position (2θ) obtained by wide-angle x-ray diffraction analysis appears at 9 to 14 degrees, to produce hydrogen adsorbed carbon and processing the hydrogen adsorbed carbon under heating and/or reduced pressure to thereby release the adsorbed hydrogen.

The present invention is, in a further aspect, a hydrogen adsorbing method comprising bringing hydrogen into contact with multifibrous carbon fiber produced by processing carbon fiber including graphitized fiber electrochemically in an acidic solution for a time sufficient to run a layer reaction such that the reaction extends to the inside of the fiber and thereafter heat-treating the carbon fiber rapidly at temperatures above 100° C. to expand the layer spacing, to adsorb hydrogen in the inside of the multifibrous carbon fiber.

The present invention is, in a further aspect, the above hydrogen adsorbing method, wherein the multifibrous carbon fiber is carbon fiber having the characteristics that the specific surface area obtained by a nitrogen gas adsorption method is 50 to 500 $m^2/g$ and a broad diffraction line in which the peak position (2θ) obtained by wide-angle x-ray diffraction analysis is 20 to 25 degrees and the half-width of the diffraction is 1 to 5 degrees appears.

The present invention is, in a further aspect, a hydrogen adsorbing comprising multifibrous carbon fiber having the characteristics that the specific surface area obtained by a nitrogen gas adsorption method is 50 to 500 $m^2/g$ and a broad diffraction line in which the peak position (2θ) obtained by wide-angle x-ray diffraction analysis is 20 to 25 degrees and the half-width of the diffraction is 1 to 5 degrees appears.

The present invention is, in a further aspect, a hydrogen adsorbing carbon obtained by bringing hydrogen into contact with the aforementioned hydrogen adsorbent.

The present invention, in a further aspect, a method of adsorbing and desorbing hydrogen, the method comprising bringing hydrogen into contact with multifibrous carbon fiber produced by processing carbon fiber including graphitized fiber electrochemically in an acidic solution for a time sufficient to run a layer reaction such that the reaction extends to the inside of the fiber and thereafter heat-treating the carbon fiber rapidly at temperatures above 100° C. to expand the layer spacing, to occlude hydrogen in the inside of the multifibrous carbon fiber, thereby forming hydrogen occluded carbon and processing the hydrogen occluded carbon under heating and/or reduced pressure to thereby desorb the adsorbed hydrogen.

PREFERRED EMBODIMENTS OF THE INVENTION

Figure 1:
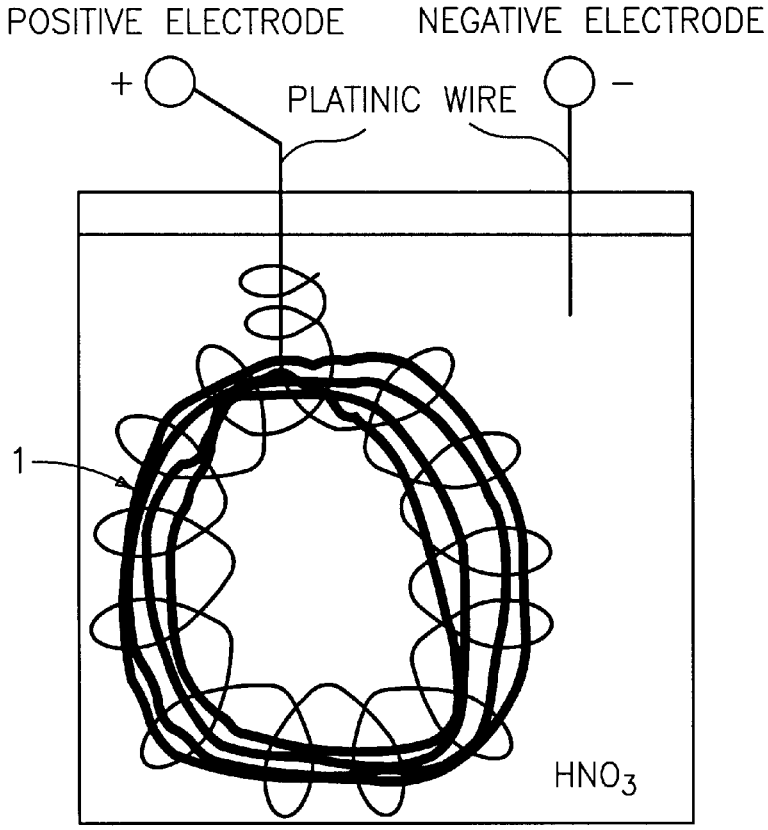
FIG. 1 is an explanatory view of an electrochemical treating apparatus used in an example.

The present invention first provide carbon fiber which is obtained by imparting a great number of layer peeling capabilities in the direction of the fabric axis of the carbon fiber and which has new structural characteristics. Here, the carbon fiber including graphitized fiber is fibers produced by calcinating a carbon fiber precursor at a temperature exceeding 800° C., preferably 1000° C. or more. Fibers graphitized by treating at a high temperature of particularly 2000° C. or more, more preferably 2600° C. or more and still more preferably 2900 to 3200° C. are preferable carbon fibers. Examples of these carbon fibers include carbon fibers such as pitch type carbon fibers, polyacrylonitrile type carbon fibers and rayon type carbon fibers. Among these carbon fibers, pitch type carbon fibers are preferable. This is because a graphite structure is easily developed during calcination.

As the raw material of pitch type carbon fiber, petroleum type pitch, coal type pitch, further synthetic pitch or the like may be used.

Specific examples of petroleum type pitch include decant oil pitch and ethylene tar pitch and specific examples of coal type pitch include coal tar pitch and liquefied coal pitch. Specific examples of synthetic pitch include a variety of pitches such as naphthalene pitch.

In the present invention, among the pitches as aforementioned, particularly pitches containing an optically anisotropic phase, namely mesophase pitches are preferably used. Pitches containing an optically anisotropic phase in a content of 50 to 100%, preferably 80 to 100% and more preferably 90 to 100% are used. The mesophase pitch in the present invention is pitches exhibiting optical anisotropy which can be viewed when the section of the pitch is observed using a polarization microscope. The content of such a pitch is shown by the area ratio of an optical anisotropic phase.

The spinning of pitch is performed by a usual melt-spinning method. As to spinning system, molten mesophase pitch is allowed to pass a nozzle slot to perform spinning. Various methods may be selected in accordance with a difference in drawing method. To state in detail, these methods include a method of preparing continuous long fiber, a method of preparing chopped fiber by cutting pitch fibers directly after spun and a method (the so-called melt blow process) of preparing pitch monofilament by introducing into a nozzle. All of these methods are usable.

The yarn diameter of pitch fiber is 7 to 50 μm and preferably 7 to 20 μm. The resulting pitch fiber is collected in a can or a conveyer and, in succession, subjected to calcinating process.

Spinning viscosity is desirably as low as possible with the view of promoting the development of a graphite structure during calcination. Specifically, spinning is performed at a viscosity of 60 Pa·s or less and preferably 10 to 30 Pa·s.

The obtained pitch fiber may be kept at generally 100 to 360° C. and preferably 130 to 320° C. for generally 10 minutes to 10 hours and preferably 1 to 6 hours in an acidic gas atmosphere to perform infusibility treatment.

As the acidic gas, oxygen, air or ozone or a mixture of each of these gases and nitrogen dioxide or chlorine may be used in general.

The fiber which has been subjected to infusibility treatment is graphitized at a temperature of 2000° C. or more, preferably 2600° C. and more preferably 2900 to 3200° C. in an atmosphere of inert gas such as nitrogen or argon to obtain carbon fiber. A primary carbonizing process may be performed at 300 to 800° C. in an inert gas atmosphere prior to the calcinating process. It is to be noted that the chopped carbon fiber may also be produced by a method in which a cutting operation is performed after the primary carbonizing process or after the graphitizing process other than the aforementioned method in which a cutting operation is performed directly after spun.

Carbon fiber which is particularly preferably used in the treatment of the present invention is one having such a developed graphite structure that the size (Lc) of a crystallite which can be found by the measurement of wide-angle x-ray diffraction is generally 20 to 100 nm, preferably 25 to 70 nm and more preferably 30 to 70 nm and the d002 spacing is 0.33 to 0.4 nm and preferably 0.33 to 0.36 nm.

The carbon fiber layer reaction product according to the present invention can be obtained by using a step of processing the aforementioned carbon fiber electrochemically in an acidic solution for a time sufficient to run a layer reaction such that the reaction extends to the inside of the fiber.

Here, the carbon fiber layer reaction product means one put in a state of an aggregate of fibers in which the spacing of a carbon structure constituting the carbon fiber is expanded using the following method: supposing one carbon fiber, an acid is contained between layers constituting the carbon fiber to thereby form a reaction product between acid-containing layers.

The formation of the aforementioned reaction product between acid-containing layers can be confirmed by the fact that the diffraction peak position (2θ) corresponding to the (002) plane which is measured using a wide-angle x-ray diffractometer is decreased in the intensitiy at 25 to 27 degrees (0.33 to 0.36 nm as converted into a layer spacing) which is the value of the carbon fiber prior to electrochemical treatment whereas a new diffraction peak appears at a lower angle. For example, when nitric acid is used as the above acid, the above reaction can be confirmed by the fact that a new diffraction peak position (2θ) appears at 9 to 14 degrees (0.63 to 0.98 nm as converted into a layer spacing) and more preferably 10 to 13 degrees (0.68 to 0.88 nm as converted into a layer spacing).

However, the three-dimensional regularity of the layer reaction product is inferred to be low from the configuration of a new diffraction line obtained by the resulting wide-angle x-ray diffraction and all of the layer spacing of carbon fiber resulting from a layer reaction caused by electrochemical treatment do not always fall in the above range.

In the present invention, as to the formation of the aforementioned reaction compound between acid-containing layers, carbon fiber is electrochemically treating in an acid solution to run a layer reaction within the fiber whereby the reaction compound can be formed between layers.

As examples of the type of carbon fiber to be subjected to the aforementioned electrochemical treatment, textile products such as fabric, felt, mat, chopped carbon fiber, two-dimensional fabric and three-dimensional fabric or unidirectional materials are given. Examples of this type of carbon fiber also include prepregs obtained by further impregnating the textile products with a resin and those obtained by fashioning the textile product under pressure after a binder such as pitch, a resin or graphite powder is further added or not added and thereafter carbonizing or calcinating the fashioned textile product according to the need and also include carbon fiber-reinforced carbon composite materials using a carbide of pitch or a resin or heat-decomposed carbon as the matrix.

As carbon fiber to be used for the aforementioned textile product, all of continuous long fiber and monofilament may be used. The aforementioned fashioned product of carbon fiber may be mixed spun products, mixed fiber products or combined fabric products of carbon fiber and other fiber such as inorganic fiber or organic fiber. It depends on what type of fiber is selected from these other fibers whether these other fibers can be removed afterwards by calcination or treatment using chemicals or can be used as it is without removing these other fibers so as to make it easy to handle the final multifibrous fiber (expanded fiber) which can be utilized in the present invention.

As the inorganic fiber, glass fiber, alumina fiber, silicon carbide fiber or metallic fiber may be used.

As the organic fiber, natural fibers or synthetic fibers may be used. Specifically, cotton yarn, silk yarn, Kevlar fiber, rayon fiber, vinylon fiber, polyester fiber or polyethylene fiber may be used.

As the electrolyte to be used in the electrochemical treatment of the present invention, an acidic solution may be usually used. Any type of acidic solution may be used as far as it causes electrodialysis.

Examples of the acid include organic acids and inorganic acids or mixtures of these acids. Examples of the inorganic acid include sulfuric acid, concentrated sulfuric acid, nitric acid, concentrated nitric acid and phosphoric acid. Examples of the organic acid include acetic acid. Concentrated nitric acid and concentrated sulfuric acid are particularly preferable. The concentration of the acid in this case is usually 5 to 20 mol/l and preferably 6 to 20 mol/l.

As to the condition of each of the electrodes and apparatuses used in the electrochemical treatment, the condition used in conventionally known electrolytic oxidation may be optionally applied. For instance, no particular limitation is imposed on the electrode to be used in the electrochemical treatment and, as a typical example, a platinum electrode having a resistance to acids may be used. Although no particular limitation is also imposed on the container used in the electrochemical treatment, a glass container is generally used.

There is also no particular limitation to the applied voltage and a proper voltage of 0.5 V or more may be used.

Since the present invention is intended not to perform surface treatment but to run a layer reaction extending to the inside of fiber. It is therefore necessary to select the conditions such as applied voltage and applied time corresponding to the aforementioned type and concentration of acid. These conditions however, can be optionally selected by preliminary experiments conducted by a person having an ordinary skill in the art. Also, these fibers may be allowed to pass continuously through an electrolytic oxidation solution to run a layer reaction of the fiber continuously.

The occurrence of the layer reaction can be confirmed by the fact that the diffraction peak position (2θ) corresponding to the (002) plane which is measured using a wide-angle x-ray diffractometer is decreased in the intensitiy at 23 to 27 degrees (0.33 to 0.4 nm as converted into a layer spacing) which is the value of the carbon fiber prior to electrochemical treatment whereas a new diffraction peak appears at a lower angle. For example, when nitric acid is used as the acid, the above reaction can be confirmed by the fact that a new diffraction peak position (2θ) appears at 9 to 14 degrees (0.63 to 0.98 nm as converted into a layer spacing) and more preferably 10 to 13 degrees (0.68 to 0.88 nm as converted into a layer spacing).

The half-width of the diffraction line which is newly produced in the above manner is in a range from 1 to 3 degrees and preferably 1 to 2 degrees.

The layer spacing (d002 plane) when a graphite crystal state is formed is measured using a wide-angle x-ray diffractometer and generally calculated according to the following Bragg's equation. Specifically, if the wavelength of the x-ray to be used is kept constant and incident angle and reflected angle (usually incident angle=reflected angle) are measured, the layer spacing can be found.

$$2d \sin \theta = n\lambda$$

where d: lattice spacing

θ: Bragg angle incident angle=reflected angle=θ

λ: wavelength of x-ray used (CuKαray: 0.154 nm)

n: reflection order

All of the values of 2θ are those measured based on the diagram of wide-angle x-ray diffraction line according to the powder method. Specific conditions of the measurement are as follows. Specifically, a sample which is crushed using an agate mortar such that all of the sample is allowed to pass through a 150 mesh standard screen is uniformly filled in a sample plate with a depth of 0.2 mm which plate is attached to an x-ray diffractometer to obtain a sample for x-ray diffraction. Using this resulting sample and a CuKαray (CuKβray is removed by a nickel filter) as the x-ray, a measurement is made in the following condition: voltage and current applied to an x-ray tube ball: 40 kV and 150 mA respectively, slit width: divergent slit ½ degrees, scattering slit ½ degrees and receiving slit 0.15 mm and operation speed of a counter: 1 degree/min, to obtain a measured value.

The carbon fiber layer reaction product obtained by running a layer reaction extending to the inside of carbon fiber in this manner may be washed with water, an organic acid or water, to which an organic acid ester is added, according to the need, to remove an acid adsorbed to the surface of the fiber, dehydrated and dried.

As the above organic acid or organic acid ester, formic acid, acetic acid, oxalic acid or esters of these acids may be used. Also, as required, the reaction product may be treated using a solution of an alkali such as ammonia, sodium hydroxide or potassium hydroxide or alkaline gas and further washed with water as required.

The carbon fiber (carbon fiber layer reaction product) in this manner after electrochemical treatment is finished is more stable than conventional carbon fiber layer reaction products and can be stored for a long period of time. The electric resistance of the carbon fiber layer reaction product is generally 20000 to 200000 μΩm and preferably 40000 to 120000 μΩm. This value is much greater compared with that of usual fiber, specifically, 10000 to 100000 times that of the usual carbon fiber.

The size of the carbon fiber after electrochemical treatment is finished is increased to 300 to 450 g/km whereas the size of the carbon fiber before the electrochemical treatment is 200 to 250 g/km.

As is understood from the above, the "carbon fiber layer reaction product" may also be called an acid-containing layer reaction product.

The carbon fiber layer reaction product obtained in the above manner has many carbon layer edges (or carbon domain edges) suitable for the adsorption or occlusion of hydrogen. When the carbon fiber layer reaction product is viewed from the point of x-ray structure, a carbon structure derived from the diffraction peak position (2θ) (23 to 27 degrees: 0.33 to 0.4 nm as converted into layer spacing) of the d002 plane of graphite is decreased and a new carbon structure derived from a new diffraction peak position (2θ) (9 to 14 degrees: 0.63 to 0.98 nm as converted into layer spacing) is created.

As is understood from the above, the "multifibrous carbon fiber" in the present invention means carbon fiber which is layer-peeled by processing carbon fiber improved in layer-peelability in the direction of the fiber axis inside of the fiber. The carbon fiber improved in layer-peelability may be called also an acid-containing layer compound and the multifibrous carbon fiber may be called also an expanded carbon fiber.

The multifibrous carbon fiber obtained in this manner has excellent characteristics even as it is. If this fiber is heated accurately to 100° C. or more and preferably 800° C. to 2000° C., layer spacing is momentarily opened wide and expanded whereby the fiber becomes porous fiber-like fiber (expanded carbon fiber) which has more cleared multifibrous characteristics. This expanded carbon fiber has excellent characteristics that it has a bulk density as high as about 0.001 to 0.01 g/cm$^3$, a high surface area and is hydrophobic and, at the same time, lipophilic. The expanded carbon fiber has many carbon layer edges (carbon domain edges) suitable for the adsorption or occlusion of hydrogen. Also, the expanded carbon has the characteristics that the peak position (2θ) which is estimated to show the (002) plane in a diffraction line obtained by the measurement of wide-angle x-ray diffraction is 20 to 25 degrees and preferably 23 to 25 degrees and its half width is 1 to 5 degrees and preferably 1 to 3.5 degrees to show that the measured diffraction line is a broad diffraction line and has 2θ still smaller than the peak position(2θ: close to 25.5 degrees) of the broad diffraction line of carbon black, exhibiting also high hydrogen-occluding ability.

It is to be noted that the value of 2θ meant in the present invention is that measured based on the diagram of x-ray diffraction line according to the powder method. Specific conditions of the measurement are as follows. Specifically, a sample which is crushed using an agate mortar such that all of the sample is allowed to pass through a 150 mesh standard screen is uniformly filled in a sample plate with a depth of 0.2 mm which plate is attached to an x-ray diffractometer to obtain a sample for x-ray diffraction. Using this resulting sample and a CuK αray (CuKβray is removed by a nickel filter) as the x-ray, a measurement is made in the following condition: voltage and current applied to an x-ray tube ball: 40 kV and 150 mA respectively, slit width: divergent slit ½ degrees, scattering slit ½ degrees and receiving slit 0.15 mm and operation speed of a counter: 1 degree/min, to obtain a measured value.

When a material having a high degree of graphitization (high crystallinity) is selected as the carbon fiber to be subjected to electrochemical treatment according to the present invention, the characteristics such as resistance to an acid and heat resistance which the carbon fiber having a high degree of graphitization possesses before it is expanded is kept as it is also after it is expanded. Therefore, the resulting carbon fiber resultantly has excellent characteristics which activated carbon fiber having inferior resistance to an acid and poor heat resistance and having the same surface area does not possess. The BET specific surface area of the multifibrous carbon fiber which area is found by the measurement of adsorption isotherm of nitrogen gas at the liquid nitrogen temperature (77K) is generally 50 to 500 m$^2$/g and preferably 100 to 400 m$^2$/g. This value is 250 to 2500 times and preferably 500 to 2000 times the typical specific area (0.2 m$^2$/g) of the general carbon fiber used as the raw material.

Figure 8:
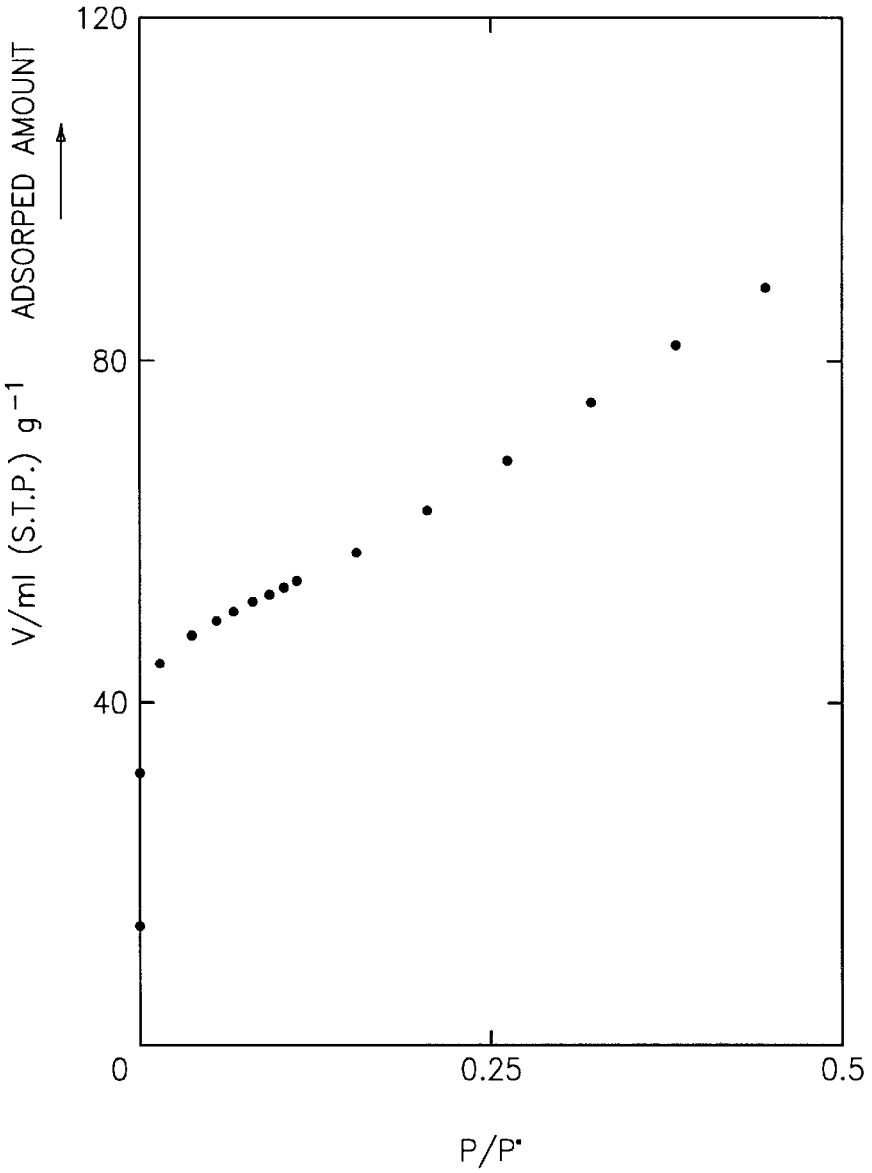
FIG. 8 is an adsorption isotherm of the multifibrous carbon fiber of the present invention.
Figure 9:
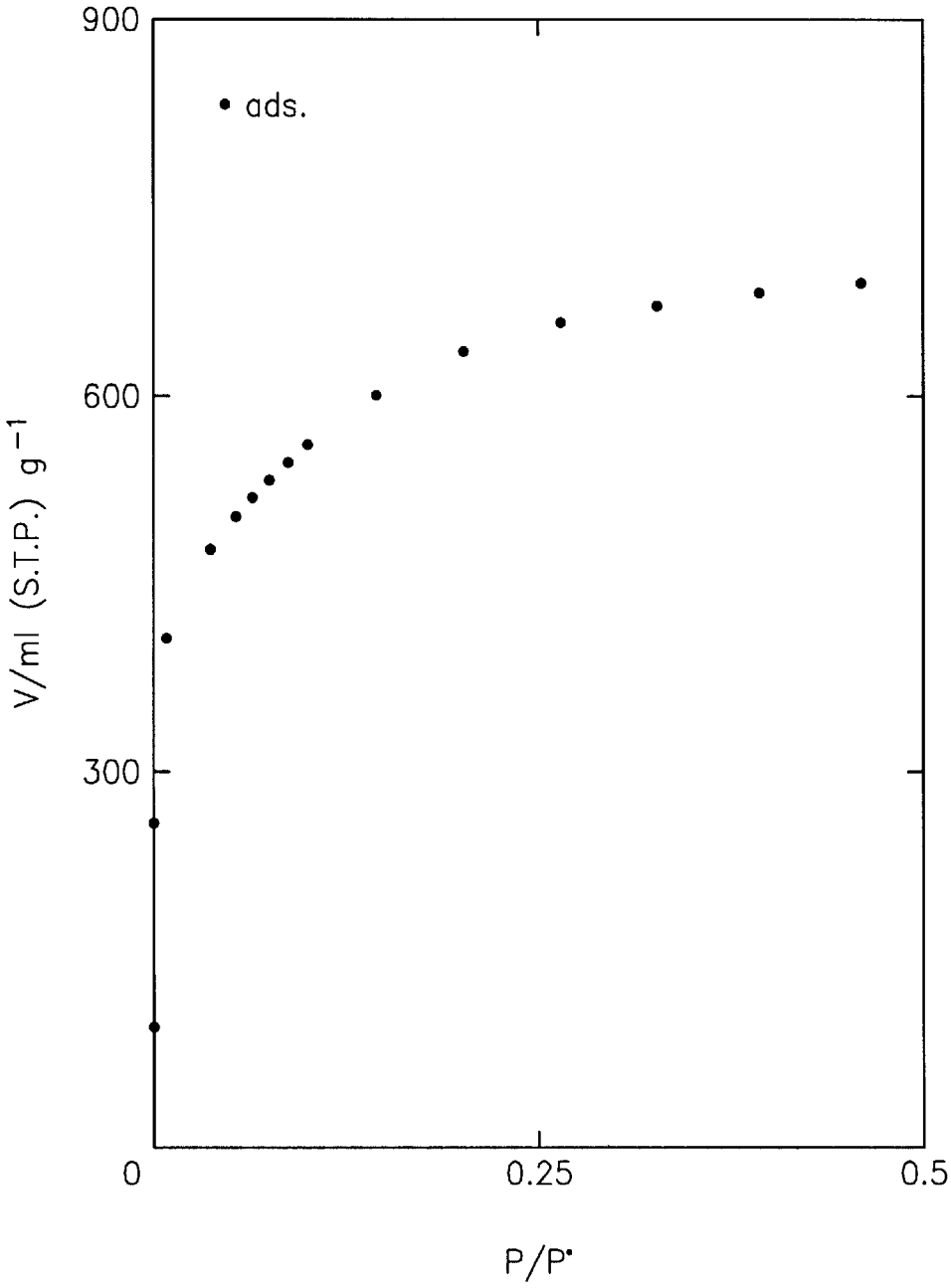
FIG. 9 is an adsorption isotherm of typical activated carbon having high specific surface area.

In the measurement of BET specific surface area, a sample weighing 0.01 to 0.2 g is deaerated at 200° C. under a pressure of 0.8 to 0.9 Pa for 1 to 7 hours and thereafter the adsorption isotherm of nitrogen gas is measured at the liquid nitrogen temperature (77K) to find the BET specific surface area (FIG. 8 (Multifibrous carbon fiber according to the present invention) and FIG. 9 (Activated carbon)). The measured isothermal line is analyzed by applying the BET theory whereby the specific surface area can be calculated.

To mention the teachings obtained from the adsorption isotherm, the adsorption isotherm of the invented material as shown in FIG. 8 has a configuration inferred as the II type from the type classification of adsorption isotherm according to the BDDT classification and is very close to the isothermal line found on the observation of a non-porous sample, showing that it is clearly different from the adsorption isotherm I type (Langmuir type) found in activated carbon which is a material having typical micropores as shown in FIG. 9.

Like conventional expanded graphite, the multifibrous carbon fiber thus obtained may be preferably used for raw materials of materials used in various industrial fields, materials for absorbing water-insoluble solutions, materials for absorbing oil and materials for adsorbing gaseous materials. The important significance of the present invention is that the multifibrous carbon fiber of the present invention is found to exhibit, as the hydrogen adsorbent, such a high performance as to absorb hydrogen easily when being brought into contact with hydrogen since it has a high reactive graphite edge structure.

According to the present invention, relatively low storing pressure is only required for the storage of hydrogen, for which high pressure of, for example, a high pressure bomb is required, by using the hydrogen occluding material of the present invention. Also, because long fibers of carbon fiber can also be used as starting material, it is possible to allow the fiber to pass continuously through a treating vessel thereby carrying out electrochemical treatment. Namely, the hydrogen occluding material of the present invention has such excellent characteristics that it has high hydrogen adsorbing ability though its manufacturing is easier and the manufacturing cost is lower than those of conventional hydrogen adsorbing carbon materials.

If hydrogen is brought into contact with the multifibrous carbon fiber of the present invention, the multifibrous carbon fiber can adsorb hydrogen. For example, the multifibrous carbon fiber of the present invention is placed in a pressure container whose capacity is known in advance. The carbon fiber is heat-treated at 100 to 500° C. for 1 to 3 hours while deaerating under vacuum. After the heat-treatment, the pressure container is cooled and a fixed amount of high pressure hydrogen gas is introduced into the container at ambient temperature such that the pressure in the container becomes 1 to 10 MPa whereby hydrogen can be occluded.

The multifibrous carbon fiber can adsorb or occlude hydrogen generally in an amount of 0.01 to 0.2 g per 1 g of the fiber.

After the multifibrous carbon fiber of the present invention adsorbs hydrogen, hydrogen gas can be desorbed easily from the fiber by using a chemical method such as heat treatment or a physical method such as treatment performed under reduced pressure. At the same time, the multifibrous carbon fiber from which hydrogen gas is desorbed can be utilized repeatedly as a hydrogen adsorbent.

The hydrogen adsorbing method of the present invention makes it possible to adsorb hydrogen with ease and to adsorb and desorb hydrogen repeatedly by treatments such as heating or pressure reduction. Therefore, if the multifibrous carbon fiber of the present invention is filled in a hydrogen bomb (high pressure container), it may be utilized in various applications which essentially require light-weight characteristics among applications for hydrogen fuel-storing means which have lighter weight and higher capacity than conventional hydrogen bomb, applications which are put to practical use at present by using a hydrogen occluding alloy and applications considered to be put to practical use.

The expanded multifibrous carbon fiber may be preferably used for materials for absorbing water-insoluble solutions, materials for absorbing oil and materials for adsorbing gaseous materials.

For example, oil-absorbing materials using the expanded multifibrous carbon fiber of the present invention not only absorb oil and the like in a large amount but also can treat materials difficult of treatment such as oil mingled in sea water or wastewater or further emulsified oil when performing recovery treatment in crude oil spillage accidents or treatment of oil in wastewater. Also, for example, the oil-absorbing material can selectively remove only crude oil or oil with high efficiency without adsorbing sea water or water. Thus the expanded multifibrous carbon fiber of the present invention has more excellent characteristics than conventional oil absorbers.

Here, examples of the oil include crude oil, heavy oil, gasoline, kerosene, naphtha, hexane and organic solvents, e.g., benzene, diethyl ether and acetate, which are scarcely soluble in water.

Also, examples of the water-type include water, sea water, wastewater and aqueous solutions.

The expanded carbon fiber of the present invention can be regenerated by a chemical method such as heat treatment or a mechanical method such as squeeze-up after it adsorbs oil and the like and, at the same time, the recovered oil can also be reused.

EXAMPLES

The present invention will be hereinafter explained in detail by way of examples.

Example 1

Pitch type carbon fiber was heat-treated in advance at 500° C. or more for 5 hours or more to remove a sizing agent. The carbon fiber (Lc=50 nm) from which the sizing agent was removed was cut to get a necessary part about 200 cm in length. The sample carbon fiber was wound along a platinum wire with a diameter of about 10 cm as shown in FIG. 1. The wound carbon fiber was fixed in the condition that it was hung from the end of the positive electrode side of a platinum electrode and immersed in a concentrated nitric acid solution. In this case, the reason why the fiber was paralleled to the platinum wire was that the potential of each part of the fiber was made to be the same potential when electrochemical treatment was performed.

A voltage of 3 to 8 V was applied by controlling current such that a d.c. current about 1A flows between the positive electrode of the platinum electrode to which the carbon fiber was fixed and the negative electrode of the platinum electrode to start electrochemical treatment of the carbon fiber. At this time, the temperature was ambient temperature and the time required for electrodialysis was 5 hours. The treated carbon fiber fixed to the positive electrode as the plus side was taken out from the nitric acid solution and then washed with sufficient water repeatedly. Thereafter, the carbon fiber was air-dried in a draft. The air-dried sample was analyzed by an x-ray diffractometer to compare the wide-angle x-ray diffraction profile (FIG. 2) of the carbon fiber before treatment with the wide-angle x-ray diffraction profile (FIG. 3) of the carbon fiber after the electrochemical treatment. As a result, it was confirmed that the intensity of the diffraction line of the d002 was weakened and a new diffraction peak appears at 11 degrees as 2θ, showing that a layer reaction product is formed. Conditions of the measurement are as follows. Specifically, a sample which was crushed using an agate mortar such that all of the sample was allowed to pass through a 150 mesh standard screen was uniformly filled in a sample plate with a depth of 0.2 mm which plate was attached to an x-ray diffractometer to obtain a sample for x-ray diffraction. Using this resulting sample and a CuKαray (CuKβray was removed by a nickel filter) as the x-ray, a measurement was made in the following condition: voltage and current applied to an x-ray tube ball: 40 kV and 150 mA respectively, slit width: divergent slit ½ degrees, scattering slit ½ degrees and receiving slit 0.15 mm and operation speed of a counter: 1 degree/min.

Figure 2:
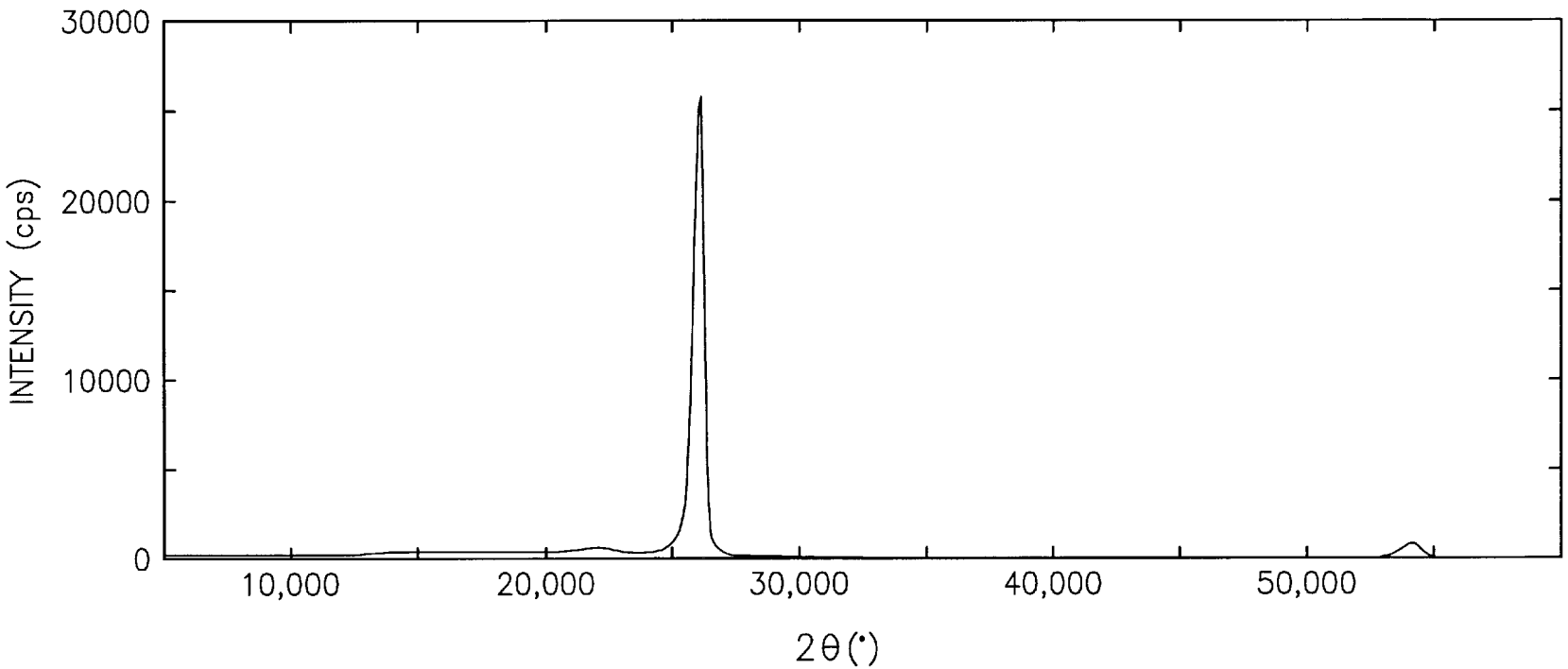
FIG. 2 is the wide-angle x-ray diffraction profile of carbon fiber prior to electrochemical process.
Figure 3:
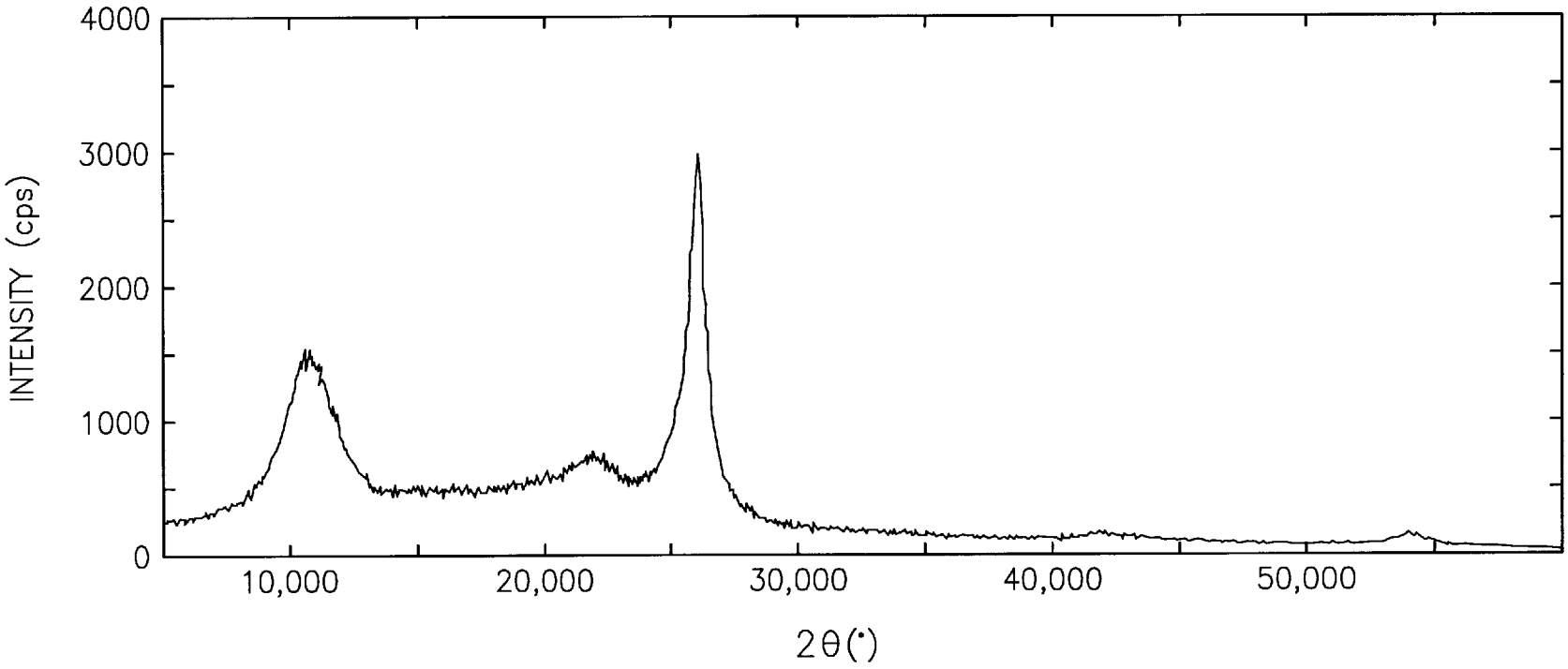
FIG. 3 is the wide-angle x-ray diffraction profile of carbon fiber after electrochemical process.
Figure 4:
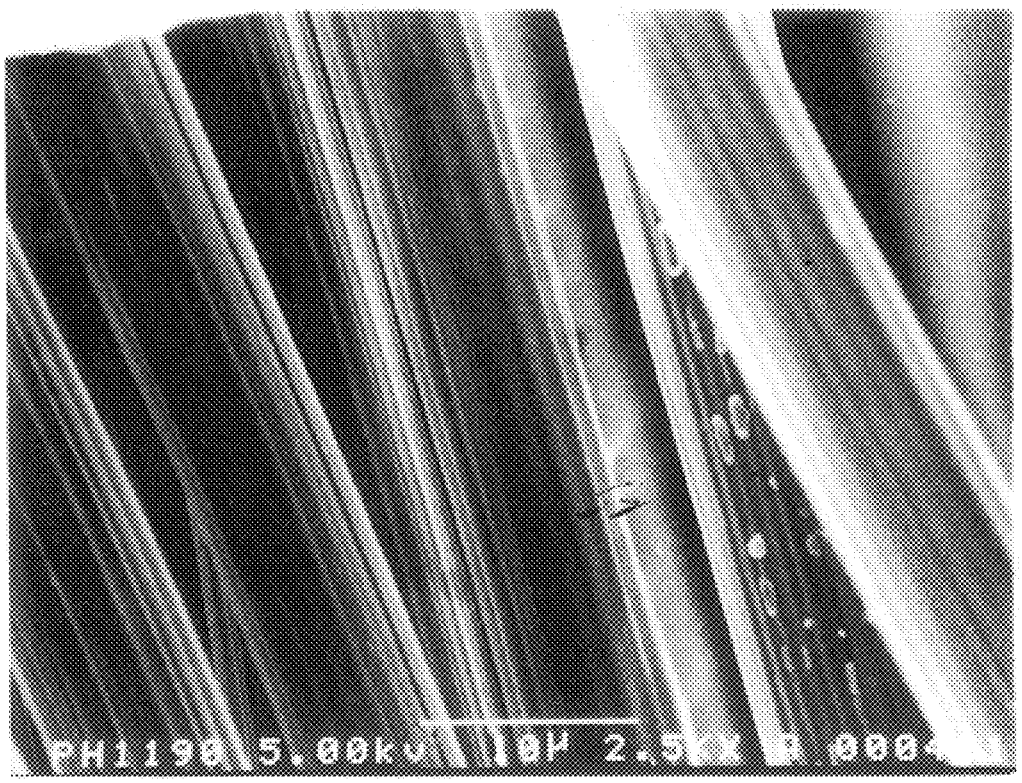
FIG. 4 is a scanning type electron microphotograph (magnification: 2500) of carbon fiber after electrochemical process.
Figure 5:
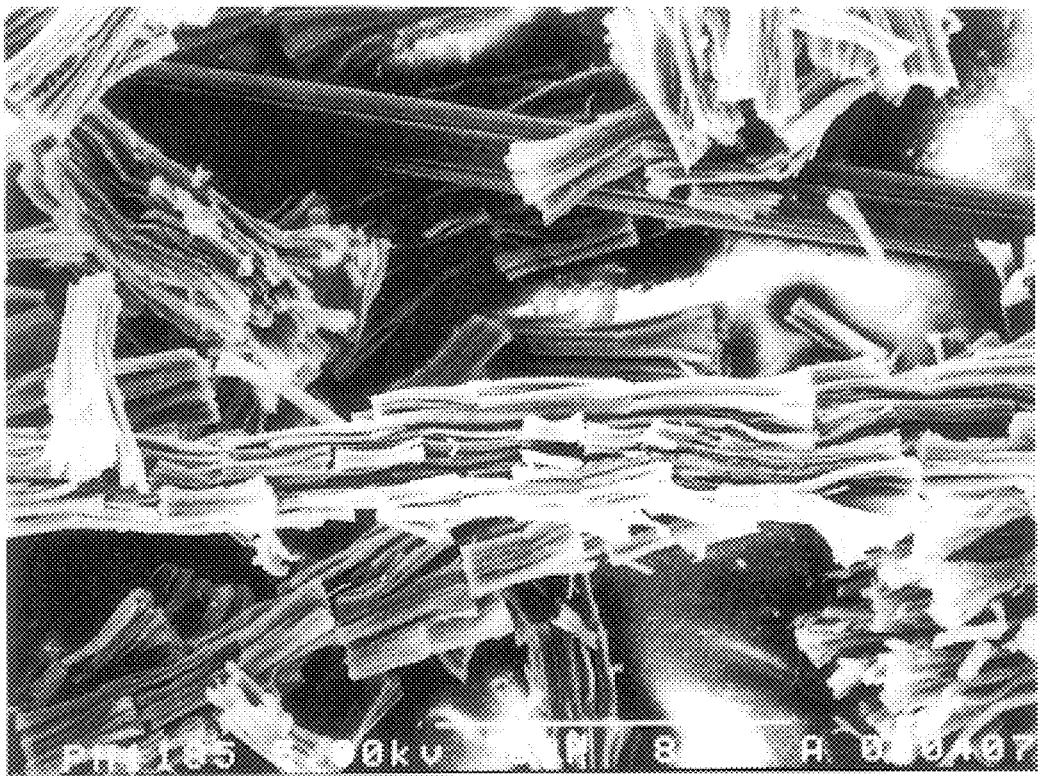
FIG. 5 is a scanning type electron microphotograph (magnification: 800) of expanded carbon fiber.
Figure 6:
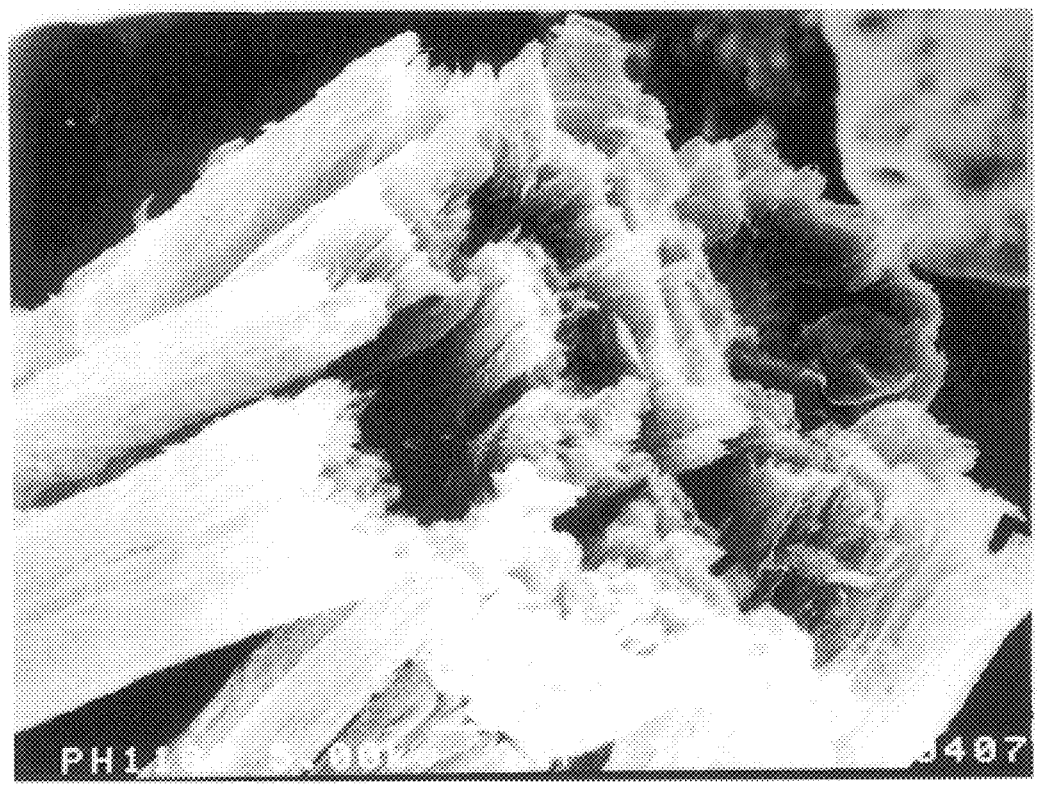
FIG. 6 is a scanning type electron microphotograph of (magnification: 15000) a partial section of expanded carbon fiber.

Table 1, FIG. 2 and FIG. 3 show the diffraction peak position of the d002 plane before the electrochemical treatment and the position of diffraction peak which newly appears after the electrochemical treatment. The carbon fiber after treated is more decreased than the original carbon fiber in the intensity of the diffraction peak of the d002 plane and a new diffraction peak appears at a lower angle, specifically in the vicinity of 10 degrees as 2θ. It is found from the above fact that a layer reaction is run extending to the inside of the fiber. Also, as shown in Tables 2 and 3, the electric resistance, the size and the like are also changed.

TABLE 1

| Change in the diffraction peak position (2θ) of the carbon fiber before and after electrochemical treatment | |
|---|---|
| Diffraction peak position of d002 plane before treatment | New diffraction peak position after treated |
| 26.3° (0.339 nm) | 11° (0.807 nm) |

*Numerals in the parenthesis show layer distance

TABLE 2

| Electric resistance of the carbon fiber before and after electrochemical treatment | |
|---|---|
| Electric resistance before treatment | Electric resistance after treatment |
| 2.61 $\mu\Omega \cdot m$ | 86000 $\mu\Omega \cdot m$ |

TABLE 3

| Size of the carbon fiber before and after electrochemical treatment | |
|---|---|
| Size before treatment | Size after treatment |
| 244 g/km | 399 g/km |

The dried sample was divided into two samples and next, one of these two samples was used to evaluate the performance of the carbon fiber layer reaction product as a hydrogen occluding material.

The carbon fiber layer reaction product was placed in a pressure container whose capacity was known in advance, followed by deaeration under vacuum. After this treatment, a fixed amount of high pressure nitrogen gas was introduced at ambient temperature such that the pressure in the pressure container became 5 MPa when the adsorbed amount was 0 and as a consequence, it was observed that the pressure was dropped down to 2.1 MPa.

From the amount of hydrogen to be introduced and the magnitude of pressure drop, it was found that hydrogen was adsorbed to the carbon fiber layer reaction product in an amount of 0.20 g per 1 g of the reaction product.

The adsorbed hydrogen could be recovered by decreasing the pressure in the pressure container containing the carbon fiber layer reaction product. About 80% of the adsorbed hydrogen was released promptly by reducing the pressure and about 20% of the adsorbed amount was not recovered and held within the material as it was.

Figure 7:
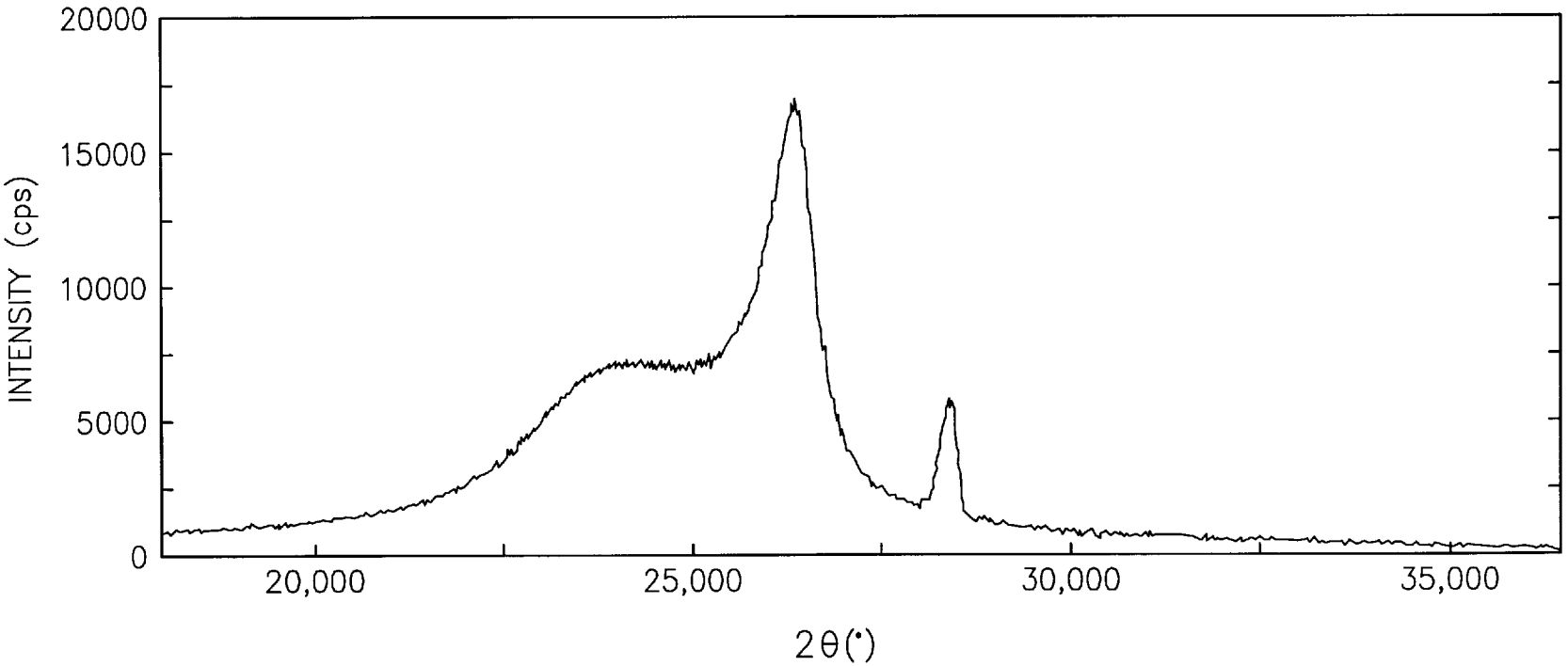
FIG. 7 is a wide-angle x-ray profile of carbon fiber after electrochemical treatment and heat treatment.

Next, the other dried sample was placed in a stainless wire basket, which was then set in an infrared heating furnace, and was heated rapidly at a prescribed temperature rise rate of 500° C./min. White smoke was emitted accompanied with a hissing sound about 15 seconds after heating was started. Thereafter, the operation of raising temperature was stopped immediately. (The similar treatment can be performed by introducing the sample into a kiln fixed to 500 to 1000° C. and by performing instantaneous heat treatment.) The sample taken out from the furnace was largely swelled cotton-wise and had a multifibrous configuration different from that of the carbon fiber before the heat treatment when viewed by the naked eye. The wide-angle x-ray diffraction profile (FIG. 2) of the carbon fiber used as the raw material before electrochemical treatment was compared with the wide-angle x-ray diffraction profile (FIG. 7) of the carbon fiber which was made to have a multifibrous configuration by the heat treatment after the electrochemical treatment. As a result, the intensity of the diffraction peak in the vicinity of 26 degrees indicating the diffraction peak position (2θ) was weakened and a new broad diffraction peak in which the diffraction peak position (2θ) appeared in the vicinity of 24 degrees and the half width was 2.8 degrees appeared.

Specific conditions of the measurement are as follows. Specifically, a sample which was crushed using an agate mortar such that all of the sample was allowed to pass through a 150 mesh standard screen was uniformly filled in a sample plate with a depth of 0.2 mm which plate was attached to an x-ray diffractometer to obtain a sample for x-ray diffraction. Using this resulting sample and a CuKαray (CuKβray was removed by a nickel filter) as the x-ray, a measurement was made in the following condition: voltage and current applied to an x-ray tube ball: 40 kV and 150 mA respectively, slit width: divergent slit ½ degrees, scattering slit ½ degrees and receiving slit 0.15 mm and operation speed of a counter: 1 degree/min.

The results of the BET specific surface area of the carbon fiber used as the raw material which surface area was measured according to the krypton gas adsorption method and the results of the BET specific surface area of the expanded carbon fiber which surface area was measured according to the nitrogen gas adsorption method are shown in Table 4.

TABLE 4

| Specific surface area of raw carbon fiber and expanded carbon fiber | |
|---|---|
| Specific surface area of raw carbon fiber | Specific surface area of expanded carbon fiber |
| 0.2 $m^2/g$ | 222 $m^2/g$ |

Next, the performance of the above carbon fiber (expanded carbon fiber) having a multifibrous configuration as a hydrogen occluding material was evaluated.

The expanded carbon fiber was placed in a pressure container whose capacity was known in advance and was heat-treated at 30° C. for 2 hours while deaerating under vacuum. After this treatment, the pressure container was cooled and a fixed amount of high pressure hydrogen gas was introduced at ambient temperature such that the pressure in the pressure container became 5 MPa when the adsorbed amount was 0 and as a consequence, it was observed that the pressure was dropped down to 3.7 MPa.

From the amount of hydrogen to be introduced and the magnitude of pressure drop, it was found that hydrogen was adsorbed to the expanded carbon fiber in an amount of 0.09 g per 1 g of the carbon fiber.

The adsorbed hydrogen could be recovered by decreasing the pressure in the pressure container containing the expanded carbon fiber. About 60% of the adsorbed hydrogen was desorbed promptly by reducing the pressure and all of about 40% of the adsorbed amount could be released by heating up to 300° C. under reduced pressure.

Comparative Example 1

Using the same carbon fiber that was used in Example 1, the carbon fiber was treated using sulfuric acid and hydrogen peroxide water, washed and dried. Thereafter, the carbon fiber was heated in an electric furnace to manufacture expanded carbon fiber. As a result, only an insufficient expansion effect was obtained. Also, the amount of hydrogen to be adsorbed was measured and, as a result, such a pressure drop as described in Example 1 was not observed, showing that no hydrogen was adsorbed.

What is claimed is:

1. A hydrogen adsorbent comprising a multifibrous carbon fiber layer reaction product which is obtained by processing carbon fiber including graphitized fiber electrochemically in an acidic solution followed by heat treating at 200 to 1200° C. and contains a carbon structure established such that the diffraction peak position (2Θ) obtained by wide-angle x-ray diffraction analysis appears at 9 to 14 degrees.

2. A hydrogen adsorbed carbon obtained by bringing hydrogen into contact with the hydrogen adsorbent as claimed in claim 1.

3. The adsorbent of claim 1, wherein the fiber including graphitized fiber is a pitch based carbon fiber.

4. The adsorbent of claim 3, wherein the pitch based carbon fiber is obtained by subjecting a pitch fiber having a diameter of 7 to 50 μm to an infusibility treatment at 180° to 360° C. in an acidic gas atmosphere and heat-treating the fiber thus treated at a temperature of 2000° C. or higher.

5. The adsorbent of claim 1, wherein the acidic solution is an aqueous solution of an acid selected from sulfuric acid, nitric acid, phosphoric acid and acetic acid.

6. The adsorbent of claim 1, wherein said multifibrous carbon fiber is layer peeled in a direction of a fiber axis inside the fiber, an acid-containing layer compound and an expanded carbon fiber.

7. The adsorbent of claim 1, wherein an intralayer or intercalation reaction has taken place inside the fiber.

8. The adsorbent of claim 6, wherein an intralayer or intercalation reaction has taken place inside the fiber.

9. The adsorbent of claim 1, wherein the diffraction peak position is 10 to 13 degrees.

10. A hydrogen adsorbent comprising multifibrous carbon fiber having the characteristics that specific surface area of the fiber obtained by a nitrogen gas adsorption method is 50 to 500 $m^2/g$ and a broad diffraction line in which the peak position (2Θ) obtained by wide-angle X-ray diffraction analysis is 20 to 25 degrees and half-width of the diffraction is 1 to 5 degrees appears, and prepared by subjecting the multifibrous carbon fiber including graphitized fiber to an electrochemical treatment in an acidic solution and heat-treating the fiber thus treated at 200° to 1200° C.

11. A hydrogen adsorbed carbon obtained by bringing hydrogen into contact with the hydrogen adsorbent as claimed in claim 10.

12. The adsorbent of claim 10, wherein the fiber including graphitized fiber is a pitch based carbon fiber.

13. The adsorbent of claim 12, wherein the pitch based carbon fiber is obtained by subjecting a pitch fiber having a diameter of 7 to 50 μm to an infusibility treatment at 180 to 360° C. in an acidic gas atmosphere and heat-treating the fiber thus treated at a temperature of 2000° C. or higher.

14. The adsorbent of claim 10, wherein the acidic solution is an aqueous solution of an acid selected from sulfuric acid, nitric acid, phosphoric acid and acetic acid.

15. The adsorbent of claim 10, wherein said multifibrous carbon fiber is layer peeled in a direction of a fiber axis inside the fiber, an acid-containing layer compound and an expanded carbon fiber.

16. The adsorbent of claim 10, in which the peak position is 23 to 25 degrees and half-width 1 to 3.5 degrees.

17. The adsorbent of claim 10, wherein the specific surface area of the fiber is 100 to 400 $m^2/g$.

18. The adsorbent of claim 10, wherein the specific surface area of the fiber is 250 to 2500 times specific area (0.2 $m^2/g$) of general carbon fiber used as raw material.

19. The adsorbent of claim 18, wherein the specific surface area of the fiber is 500 to 2000 times the specific area of the general raw material carbon fiber.

20. The adsorbent of claim 9, wherein an intralayer or intercalation reaction has taken place inside the fiber.

21. The adsorbent of claim 15, wherein an intralayer or intercalation reaction has taken place inside the fiber.

* * * * *